US008197024B2

(12) United States Patent
Kovacs et al.

(10) Patent No.: US 8,197,024 B2
(45) Date of Patent: Jun. 12, 2012

(54) COOLER FOR A PRINTER

(75) Inventors: Gregory Joseph Kovacs, Webster, NY (US); Bryan James Roof, Newark, NY (US); Michael D. Thompson, Rochester, NY (US); Edward B. Caruthers, Rochester, NY (US); Lawrence Floyd, Jr., Rochester, NY (US); Shawn R. Rowan, Dansville, NY (US)

(73) Assignee: Xerox Corporation, Norwalk, CT (US)

( * ) Notice: Subject to any disclaimer, the term of this patent is extended or adjusted under 35 U.S.C. 154(b) by 366 days.

(21) Appl. No.: 12/608,059

(22) Filed: Oct. 29, 2009

(65) Prior Publication Data

US 2011/0102491 A1 May 5, 2011

(51) Int. Cl.
*B41J 29/38* (2006.01)
*B41J 29/377* (2006.01)
*B41J 29/393* (2006.01)

(52) U.S. Cl. ..... 347/18; 347/17; 347/19

(58) Field of Classification Search ..... 347/16–19
See application file for complete search history.

(56) References Cited

U.S. PATENT DOCUMENTS

| | | | | |
|---|---|---|---|---|
| 4,751,528 | A * | 6/1988 | Spehrley et al. | 347/18 |
| 5,783,038 | A | 7/1998 | Donigian et al. | |
| 7,475,973 | B2 * | 1/2009 | Kruijt | 347/88 |
| 7,538,426 | B2 * | 5/2009 | Yamabuchi et al. | 257/714 |
| 2006/0214984 | A1 * | 9/2006 | Hirakawa | 347/31 |
| 2007/0269619 | A1 | 11/2007 | Kato et al. | |

* cited by examiner

*Primary Examiner* — Jason Uhlenhake
(74) *Attorney, Agent, or Firm* — Maginot, Moore & Beck, LLP

(57) ABSTRACT

An inkjet printer has been developed that reduces the effects of show-through by depositing ink onto a cooled print medium. The inkjet printer includes a printhead and a cooler. The printhead is configured to eject ink onto an ink receiving member as the ink receiving member is transported along a portion of a media path through the inkjet printer. The cooler is positioned proximate the media path to cool the ink receiving member prior to the printhead ejecting ink onto the ink receiving member.

16 Claims, 5 Drawing Sheets

COOLER FOR A PRINTER

TECHNICAL FIELD

The process and device described below relate to inkjet imaging devices and, more particularly, to inkjet imaging devices that condition an image receiving substrate for ink image formation.

BACKGROUND

Drop on demand inkjet technology for producing printed media has been employed in products such as printers, multifunction products, plotters, and facsimile machines. Generally, an inkjet image is formed by selectively ejecting ink drops from a plurality of drop generators or inkjets, which are arranged in a printhead or a printhead assembly, onto an image receiving substrate. For example, the printhead assembly and the image receiving substrate may be moved relative to one other and the inkjets may be controlled to emit ink drops at appropriate times. The timing of the inkjet activation is performed by a printhead controller, which generates firing signals that activate the inkjets to eject ink. The image receiving substrate may be an intermediate image member, such as a print drum or belt, from which the ink image is later transferred to a print medium, such as paper. The image receiving substrate may also be a moving continuous web of print medium or sheets of a print medium onto which the ink drops are directly ejected. The ink ejected from the inkjets may be liquid ink, such as aqueous, solvent, oil based, UV curable ink, or the like, which is stored in containers installed in the printer. Alternatively, the ink may be loaded in a solid or a gel form and delivered to a melting device, which heats the ink to generate liquid ink that is supplied to a printhead.

Typically, ink drops deposited on an obverse side of a print medium should be affixed to the obverse side without bleeding through or penetrating to a reverse side of the print medium. Penetration of an ink drop through the thickness of a print medium is referred to as "show-through", because the ink originally deposited on the obverse side is visible on the reverse side of the print medium. Show-through may also occur when an ink drop only partially penetrates the thickness of a print medium, but is still visible on the reverse side. Show-through reduces the image quality of duplex printing operations, which form an image on both sides of the print medium. Specifically, ink deposited on an obverse side of a print medium may at least partially penetrate the print medium and blur or distort an image formed with ink deposited on a reverse side of the print medium. Show-through also affects simplex printing operations, which form an image on only the obverse side of the print medium, because the obverse image density is reduced, and the reverse side of a print medium should generally remain free from ink deposits.

Show-through is related to the properties of the print medium and the ink ejected onto the print medium. For instance, some print mediums have a porous structure that permits an ink to penetrate the print medium before the ink stabilizes, cures, or hardens. Additionally, the viscosity of the ink ejected onto the print medium may result in show-through. For example, inks having a low viscosity are more likely to be absorbed by the print medium than inks having a high viscosity. For these reasons and others, efforts to reduce show-through have been directed to either the properties of the ink or the print medium onto which the ink is deposited.

Processes for reducing show-through are effective, but often limit the type of print medium or ink that may be used by an inkjet printer. For instance, show-through may be reduced or eliminated by coating a print medium with a polymer that makes the print medium have a nonporous surface. The nonporous surface prevents ink deposited onto the print medium from penetrating to a reverse side of the print medium. Polymer coated papers, however, are expensive and certain inks cannot effectively adhere to them. Additionally or alternatively, a printer may be configured to eject only inks having a high viscosity. Many inks, however, do not have a viscosity great enough to prevent the effects of show-through completely, especially on porous print mediums. Accordingly, further developments to reduce show-through are desirable.

SUMMARY

An inkjet printer has been developed that reduces the effects of show-through by depositing ink onto a cooled print medium. The inkjet printer includes a printhead and a cooler. The printhead is configured to eject ink onto an ink receiving member as the ink receiving member is transported along a portion of a media path through the inkjet printer. The cooler is positioned proximate the media path to cool the ink receiving member to a temperature less than an ambient temperature prior to the printhead ejecting ink onto the ink receiving member.

A printing system has been developed that forms an image on a cooled ink receiving member. The printing system includes a support frame, a printhead, a platen, and a cooling device. The support frame is configured to define a media path through the printing system. The printhead is configured to eject ink onto an ink receiving member as the ink receiving member is transported along a portion of the media path. The platen is coupled to the support frame and is configured to cool the ink receiving member to a temperature less than an ambient temperature prior to the printhead ejecting ink onto the ink receiving member. The cooling device is coupled to the support frame and thermally coupled to the platen to remove heat from the platen.

A method for forming and fixing a printed image on a cooled image receiving member has been developed. The method includes cooling an image receiving member to a first predetermined temperature and ejecting ink droplets onto the cooled image receiving member with a printhead.

BRIEF DESCRIPTION OF THE FIGURES

The foregoing aspects and other features of the present disclosure are explained in the following description, taken in connection with the accompanying drawings.

DETAILED DESCRIPTION

The device and method described herein make reference to a printer. The term "printer" refers, for example, to reproduction devices in general, such as printers, facsimile machines, copiers, and related multi-function products. While the specification focuses on an inkjet printer, the device and method described herein may be used with any printer that ejects ink onto an image receiving surface. Furthermore, the device and method described herein may be used with printers that form printed images with either aqueous ink, phase change ink, or gel ink, as described below.

Figure 1:
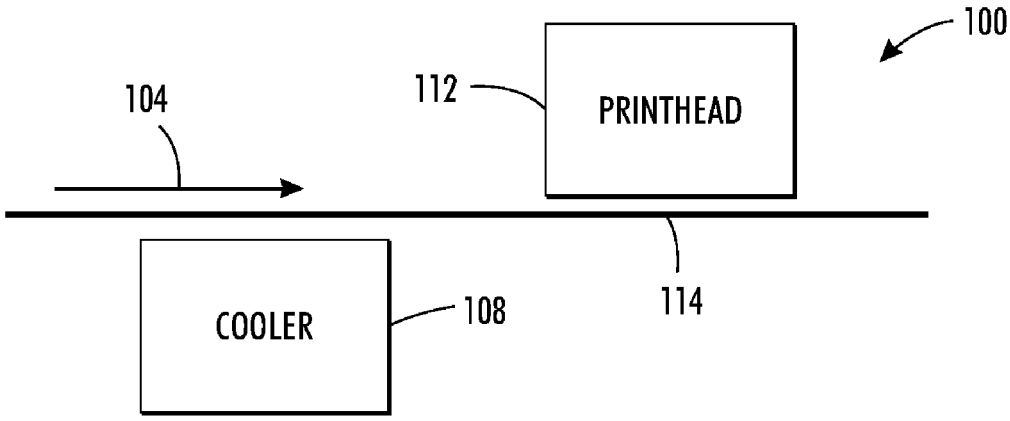
FIG. 1 is a block diagram depicting a side view of a printing system having a cooler, as described herein.

As shown in FIG. 1, a printer 100 includes a media path 104, a cooler 108, and a printhead 112. The printer 100 includes a system that transports an image receiving substrate 114, such as an ink receiving member, a print medium, sheets of a print medium, or a continuous web of print medium, along the media path 104. Although the illustrated media path 104 has a linear configuration, the media path 104 may also have a non-linear or irregular configuration. The cooler 108 cools the substrate 114 to a predetermined temperature as the substrate 114 is transported across the cooler 108. The printhead 112 ejects droplets of liquid ink onto the cooled substrate 114 to form at least a portion of a printed image. The term "liquid ink" as used herein, includes, but is not limited to, aqueous inks, liquid ink emulsions, pigmented inks, phase change inks in a liquid phase, and gel inks having been heated or otherwise treated to alter the viscosity of the ink for improved jetting. Furthermore, as used herein, ejecting ink with a printhead 112 includes, but is not limited to, ejecting ink with thermal ink ejectors and piezoelectric ink ejectors, among other types of ink ejectors, as is known in the art. The ink ejected onto the cooled substrate 114 dries, solidifies, gelatinizes, freezes, changes phase, increases in viscosity, or otherwise stabilizes before the ink penetrates the substrate 114 sufficiently to produce show-through on a reverse side of the substrate 114.

Figure 2:
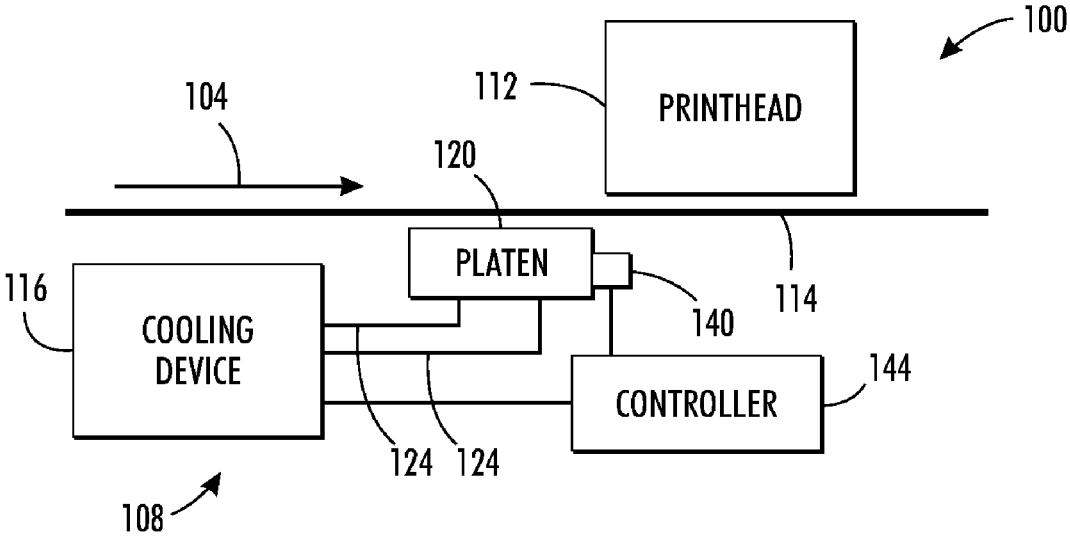
FIG. 2 is a block diagram depicting a side view of an alternative embodiment of the printing system of FIG. 1.

As shown in FIG. 2, one embodiment of the cooler 108 includes a cooling device 116 thermally coupled to a platen 120. The cooling device 116 is coupled to a support frame (not illustrated) of the printer 100. In response to being activated, the cooling device 116 removes heat from the platen 120 causing the temperature of the platen 120 to fall below an ambient temperature. As used herein, the ambient temperature is the temperature of the air surrounding the printer 100. The ambient temperature may be a room temperature when the printer 100 is positioned in a defined space. The ambient temperature may be above a room temperature when portions of the printer 100 including, but not limited to, the media path 104 and the printhead 112, are enclosed by, for example, a cover.

The cooling device 116 is any type of device capable of cooling the platen 120. In particular, the cooling device 116 may be a refrigeration unit configured to cool a fluid such as, but not limited to, water, glycol, ethylene glycol, diethylene glycol, propylene glycol, or mixtures of such fluids. The fluid cooled by the cooling device 116 is coupled to the platen 120 through a conduit 124. The conduit 124 channels the fluid cooled by the cooling device 116 into thermal contact with the platen 120 to remove heat from the platen 120. The conduit 124 may be connected to the platen 120 in a serpentine configuration, among other configurations, to remove heat evenly from the platen 120.

The platen 120 is positioned adjacent to a portion of the media path 104 prior to the printhead 112. In particular, the platen 120 may be coupled to the support frame of the printer 100 proximate to or in contact with the substrate 114. For instance, the platen 120 may be positioned to contact directly the substrate 114. Alternatively, the platen 120 may be positioned approximately 0.5 to 2.0 centimeters below the substrate 114. In another embodiment, the platen 120 is connected to a lower surface of the media path 104 to cool an upper surface of the media path 104 on which the substrate 114 is transported. Although the platen 120 and cooling device 116 are depicted as being located below the substrate 114, in other embodiments, the platen 120 and/or cooling device 116 may be positioned above the substrate 114 to cool directly the surface of the substrate 114 configured to receive ink.

The platen 120 may have an irregular surface configured to be positioned proximate to the substrate 114. The irregular surface may include channels or valleys for diverting condensation that may form on the platen 120 into a collection tank or a drain. Positioning the platen 120 below the substrate 114 reduces the possibility of condensation falling onto or otherwise contacting the substrate 114; however, the platen 120 may be positioned above the substrate 114 without causing condensation to contact the substrate 114. The platen 120 may also have an approximately planar surface configured to contact the substrate 114. The platen 120 is formed of a thermally conductive material, including, but not limited to, aluminum, copper, or any other thermally conductive metal or alloy of materials having similar thermal properties.

Figure 3:
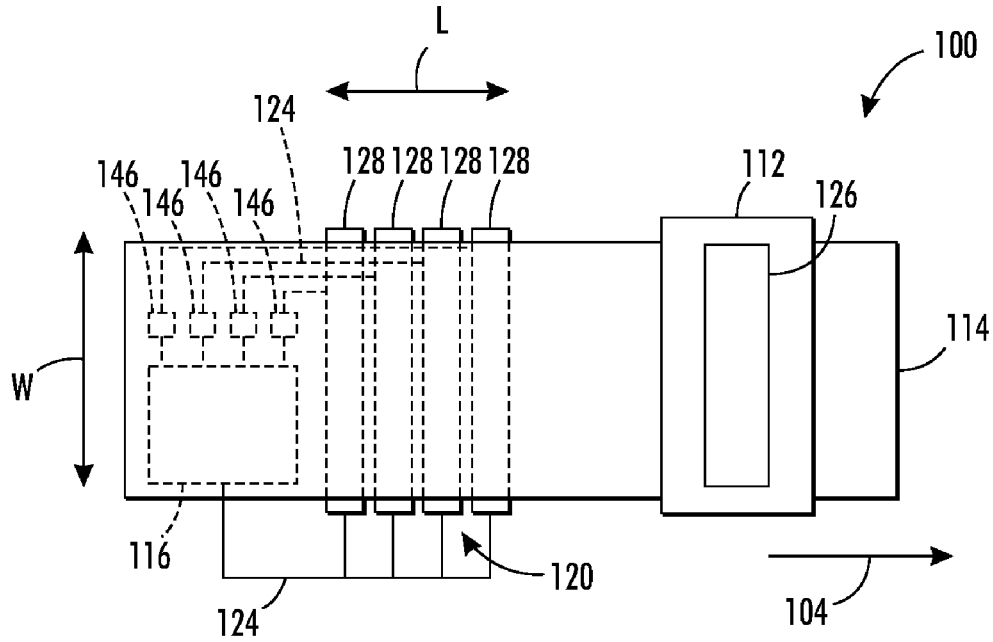
FIG. 3 is a block diagram depicting a top view of the printing system of FIG. 2 including an embodiment of the platen.
Figure 4:
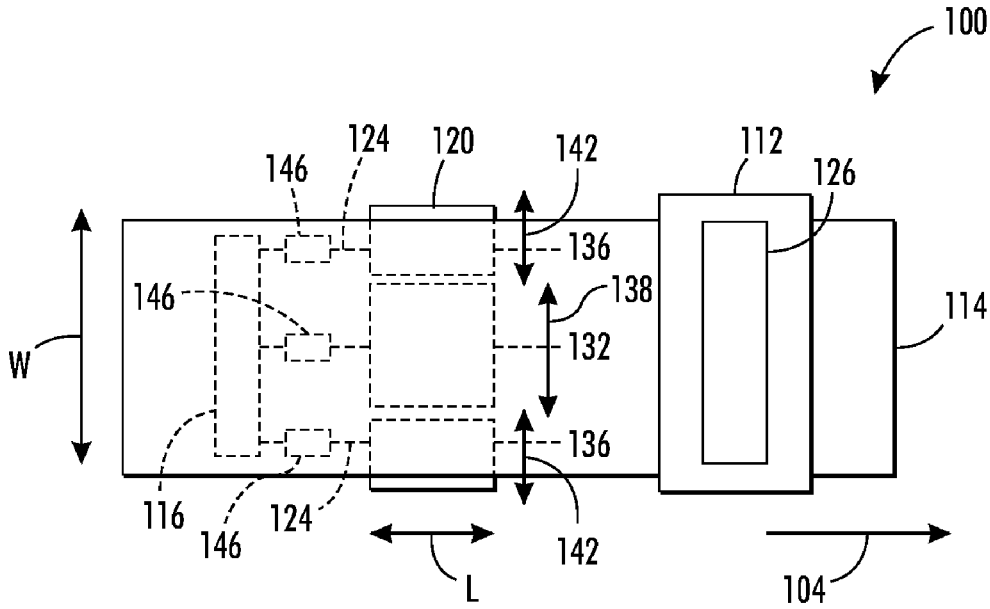
FIG. 4 is a block diagram depicting a top view of the printing system of FIG. 2 including an embodiment of the platen.

The platen 120 cools each type of substrate 114 transported on the media path 104. In particular, as shown in FIGS. 3 and 4, the platen 120 has a width W at least as wide as a print width 126 of the printhead 112. The print width 126 of the printhead 112 refers to a distance between an uppermost printable area and a lowermost printable area (FIGS. 3 and 4). Therefore, the platen 120 may cool the entire portion of the substrate 114 onto which the printhead 112 is capable of ejecting ink.

The platen 120 is configured with a length L that enables the cooling device 116 to reduce sufficiently the temperature of the substrate 114 for a range of speeds used to transport the substrate 114 along the media path 104. The printer 100 may adjust the speed at which the substrate 114 is moved along the media path 104 for different types of print jobs. Consequently, the substrate 114 is exposed to the platen 120 for different periods of time. The platen 120, therefore, is configured with a length L that enables the substrate 114 to be cooled sufficiently even when the substrate 114 is moving at a maximum print speed.

To address further variations in substrate temperatures and time periods for platen 120 exposure, the printer 100 may adjust the temperature of the platen 120. To implement temperature variations of the platen 120, in one embodiment, a temperature sensor 140 may be coupled to the platen 120 to generate an electronic signal indicative of the temperature of the platen 120, as shown in FIG. 2. Any type of temperature sensor 140 capable of sensing temperatures between negative twenty degrees Celsius and fifty degrees Celsius may be used. For instance, the temperature sensor 140 may be one or more appropriate thermocouples or thermistors. Referring again to FIG. 2, the cooler 108 may include a controller 144 coupled to the cooling device 116 and configured to maintain the platen 120 at the predetermined temperature. The controller 144 compares a temperature measured by the temperature sensor 140 to either a range of temperatures or a temperature set point and then activates selectively the cooling device 116 in response to the measured temperature exceeding the upper limit of the temperature range or the temperature set point. The controller 144 may adjust the set point temperature or range of temperatures to accommodate environmental or print job parameter changes. An exemplary range of temperatures, in one embodiment, ranges from two degrees Celsius to fifteen degrees Celsius. An exemplary set point temperature, in one embodiment, is ten degrees Celsius.

The controller 144 may include a first selector (not illustrated) for controlling whether the platen 120 is cooled to a set point temperature or is cooled within a temperature range. Additionally, the cooler 108 may include a second selector (not illustrated) for adjusting the temperature range and/or the set point temperature. The temperature range and/or the set point temperature may also be adjusted and determined with a computer (not illustrated), which is electrically coupled to the controller 144. Coupling a computer to the controller 144 permits a user to monitor and to control remotely the cooling device 116. Furthermore, coupling a computer to the controller 144 permits a computer program to calculate the temperature range and/or the set point temperature in response to a plurality of factors, such as, but not limited to, print speed, substrate type, ink type, humidity levels, ambient temperature, and the particular image being printed. In other embodiments, the temperature range and/or the set point temperature may be empirically determined or manually calculated in response to print speed, substrate type, ink type, humidity levels, ambient temperature, and the particular image being printed, among other factors.

In some embodiments, the platen 120 is formed of multiple sections referred to herein as sub-platens 128. As shown in FIG. 3, the printer 100 may include four sub-platens 128. Each sub-platen 128 has a width W that extends across the entire print width 126 of the printhead 112. The sub-platens 128 are individually coupled to the cooling device 116 in response to the demands of the printer 100. For instance, a print job in which the substrate 114 moves at a comparatively low speed or a print job requiring only a moderate reduction in the temperature of the substrate 114 may require the cooling device 116 to cool only one of the sub-platens 128. A print job in which the substrate 114 moves at a comparatively high speed or a print job requiring a greater reduction in the temperature of the substrate 114, however, may require the cooling device 116 to cool additional or all of the sub-platens 128. The cooler 108 operates efficiently by cooling only the sub-platens 128 required to prevent show-through or to reduce show-through to an unobjectionable level.

In another embodiment, illustrated in FIG. 4, a central sub-platen 132 is bordered by two lateral sub-platens 136. In the illustrated embodiment, the width 138 of the central sub-platen 132 and the width 142 of the lateral sub-platens 136 are less than the print width 126. A total width W of the sub-platens 132, 136, however, is greater than or equal to the print width 126. If a substrate 114 has a width less than or equal to the width 138 of the central sub-platen 132, the cooling device 116 may be configured to cool only the central sub-platen 132. Similarly, the cooling device 116 may be configured to cool only the central sub-platen 132 when the width of an image to be formed on the substrate 114 is less than or equal to the width 138 of the central sub-platen 132. The cooling device 116 cools the lateral sub-platens 136 at least for print jobs in which a printed image is to be formed on regions of the substrate 114 beyond the width 138 of the central sub-platen 132.

As shown in FIGS. 3 and 4, the cooler 108 may include valves 146 configured to couple and to decouple the sub-platens 128, 132, 136 from the cooling device 116. Specifically, a valve 146 may be fluidly coupled to the conduit 124 between the cooling device 116 and each sub-platen 128, 132, 136 to permit any combination of sub-platens 128, 132, 136 to be coupled to the cooling device 116. The valves 146 are movable between an open position that couples the sub-platens 128, 132, 136 to the cooling device 116, and a closed position that decouples the sub-platens 128, 132, 136 from the cooling device 116. The valves 146 may be manually moved between the open and closed positions. Additionally or alternatively, an actuator (not illustrated) may be coupled to each valve 146 for moving the valves 146 between the open and closed positions. In particular, an actuator may open a valve 146 in response to receiving a first electronic signal from the controller 144 and may close a valve 146 in response to receiving a second electronic signal from the controller 144.

Additionally or alternatively, the cooler 108 may impinge cooled air or another gas against the substrate 114 to cool the substrate 114. The apparatus and methods described above for controlling the temperature of the platen 120 may also be configured in a manner useful for controlling the temperature and flow of a cooled gas against the substrate 114. For example, a heat exchanger may be used to cool a gas sufficiently that a flow of the cooled gas directed against the substrate 114 regulates the temperature of the substrate 114 in a predetermined range.

Figure 5:
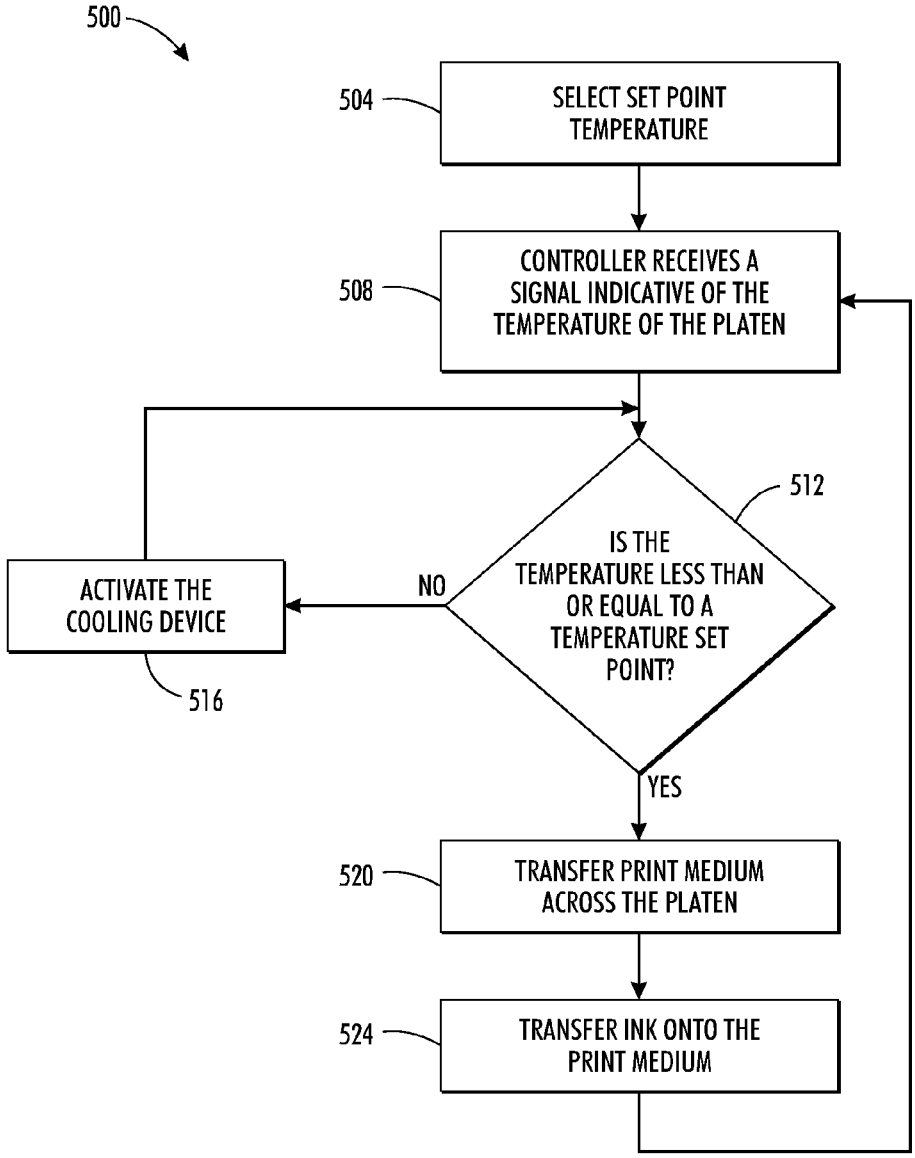
FIG. 5 is flowchart illustrating a process for operating the printing system of FIG. 2.

In operation, the printer 100 prevents show-through by cooling the substrate 114 prior to the printhead 112 ejecting ink onto the substrate 114. An exemplary method of operating the printer 100 is illustrated by the process of FIG. 5. The process 500 begins with the selection of a set point temperature (block 504). A user may calculate or determine the set point temperature by considering a variety of factors including, but not limited to, print speed, substrate type, ink type, humidity levels, ambient temperature, and the particular image being printed. A plurality of set point temperatures may be stored in an electronic memory to enable a user to select a particular set point temperature after considering the above-identified factors. Embodiments of the printer 100 having a computer coupled to the controller 144 may enable a user to enter the above-identified factors into a computer program configured to determine the set point temperature. Additionally or alternatively, the set point temperature may be at least partially determined by measuring the porosity of the substrate 114. For instance, the printer 100 may measure the porosity of the substrate 114 with an optical sensor configured to detect the intensity of a light source transmitted by the substrate 114.

Next, the controller 144 receives from the temperature sensor 140 a signal indicative of the temperature of the platen 120 (block 508). If the temperature of the platen 120 is greater than the set point temperature, the controller 144 activates the cooling device 116 to cool the platen (blocks 512 and 516). In response to the controller 144 determining that the cooling device 116 has cooled the platen 120 to at least the set point temperature, the printer 100 may begin moving the substrate 114 along the media path 104 (block 520). The cooled platen 120 removes heat from the substrate 114 before the printhead 112 ejects ink onto the substrate 114 (block 524). In response to contacting the cooled substrate 114, the ink bonds to the obverse surface of the substrate 114 without penetrating the substrate 114 sufficiently to cause show-through. In particular, even a radiation curable gel ink does not have sufficient thermal energy to raise the temperature of the substrate 114 above a temperature that permits the ink to penetrate the substrate 114, as described below.

The printer 100 may be configured to form printed images with phase change ink or gel ink. The term "phase change ink" encompasses inks that remain in a solid phase at an ambient temperature and that melt into a liquid phase when heated above a threshold temperature, referred to as a melt temperature. Phase change ink is ejected onto the substrate 114 in the liquid phase. An exemplary range of melt temperatures is approximately seventy to one hundred forty degrees Celsius; however, the melt temperature of some types of phase change ink may be above or below the exemplary temperature range. The terms "gel ink" or "gel-based ink" encompass inks that remain in a gelatinous state at the ambient temperature and that may be altered to have a different viscosity suitable for ejection by the printhead 112. In particular, gel ink in the gelatinous state may have a viscosity between $10^5$ and $10^7$ centipoise ("cP"); however, the viscosity of gel ink may be reduced to a liquid-like viscosity by heating the ink above a threshold temperature, referred to as a gelation temperature. An exemplary range of gelation temperatures is approximately thirty to fifty degrees Celsius; however, the gelation temperature of some types of gel ink may be above or below the exemplary temperature range.

Some inks, including gel inks, may be cured during the printing process. Radiation curable ink becomes cured after being exposed to a source of radiation. Suitable radiation may encompass the full frequency (or wavelength) spectrum including, but not limited to, microwaves, infrared, visible, ultraviolet, and x-rays. In particular, ultraviolet-curable gel ink, referred to herein as UV gel ink, becomes cured after being exposed to ultraviolet radiation.

Figure 6:
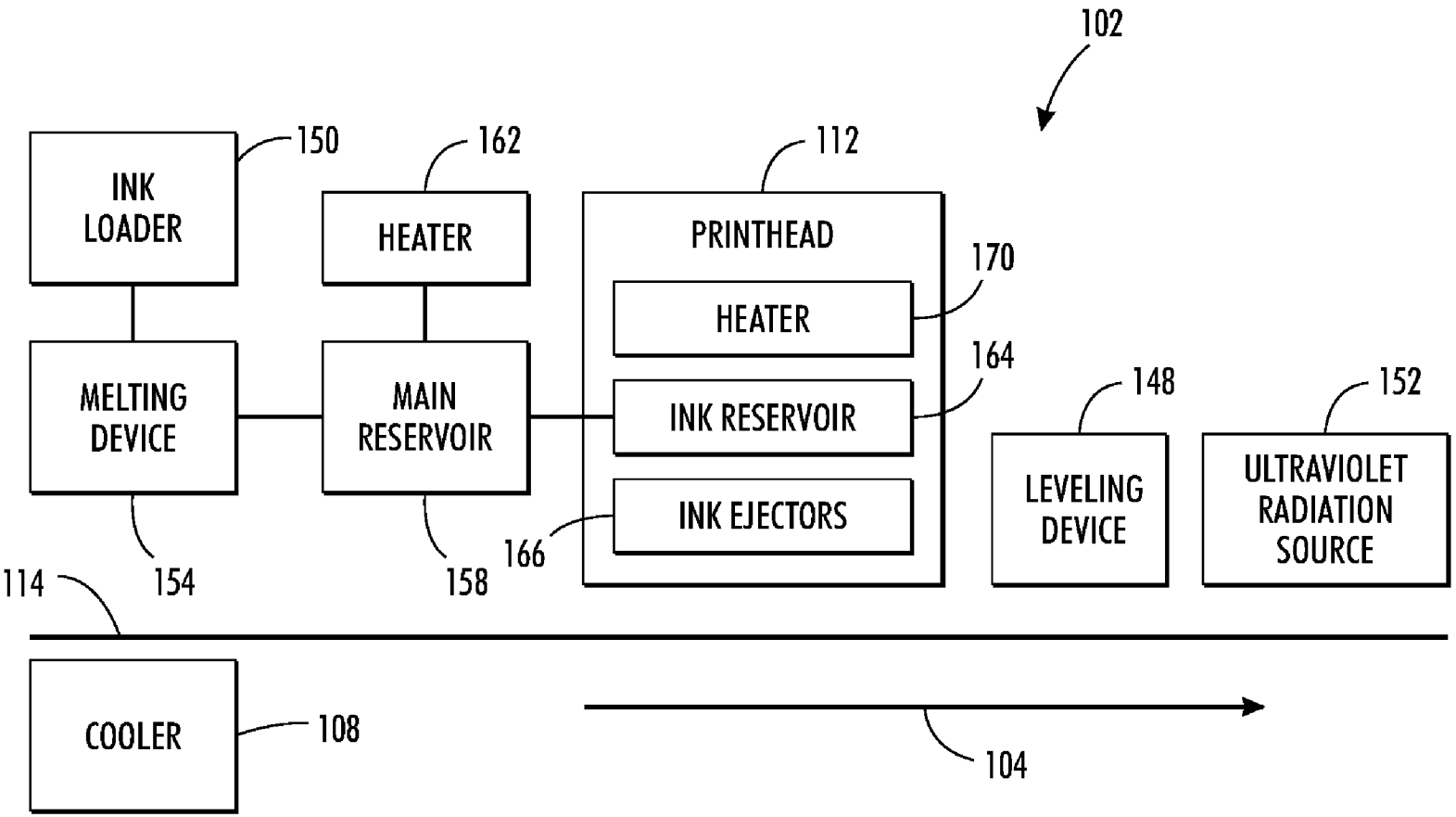
FIG. 6 is a block diagram depicting a side view of a printing system having a cooler, as described herein.

As shown in FIG. 6, a printer 102 configured to form images with phase change ink and/or gel ink may include an ink loader 150, a melting device 154, a main reservoir 158, a leveling device 148, and an ultraviolet radiation source 152. When the printer 102 is configured to form printed images with phase change ink, the ink loader 150 contains a quantity of phase change ink in the solid phase. Phase change ink is supplied to the ink loader 150 as solid ink pellets or solid ink sticks, among other forms. The ink loader 150 moves the phase change ink toward the melting device 154, which melts a portion of the ink into the liquid phase. The liquid ink is delivered to the main reservoir 158, which is thermally coupled to a heater 162 configured to heat the main reservoir 158 to a temperature that maintains the phase change ink in the liquid phase. Liquid ink from the main reservoir 158 is delivered to the printhead 112. In particular, the ink is delivered to an ink reservoir 164 within the printhead 112. The ink reservoir 164 is fluidly coupled to a plurality of ink ejectors 166 configured to eject ink onto the substrate 114. The ink ejectors 166 may be piezoelectric ink ejectors, among other types of ink ejectors, as is known in the art. The printhead 112 also includes a heater 170 for maintaining the ink contained by the ink reservoir 164 in the liquid phase. To form printed images with phase change ink the leveling device 148 may be required, but in general the ultraviolet radiation source 152 is not required. Therefore, a printer 102 configured to form printed images with only phase change ink may not include a leveling device 148 and an ultraviolet radiation source 152.

As described above, the printer 102 of FIG. 6 may also be configured to form printed images with gel ink. In particular, the printer 102 may be configured to form printed images with UV gel ink. The ink loader 150 contains a quantity of UV gel ink in the gelatinous state and moves the UV gel ink toward the melting device 154, which heats a portion of the ink above the gelation temperature to cause the ink to have a liquid-like viscosity. The heated ink is delivered to the main reservoir 158, which is thermally coupled to a heater 162 configured to heat the main reservoir 158 to a temperature that maintains the liquid-like viscosity of the UV gel ink. The ink from the main reservoir 158 is transferred to the reservoir 164 in the printhead 112 for ejection by the ink ejectors 166. The ink ejectors 166 may be piezoelectric ink ejectors, among other types of ink ejectors, as is known in the art. Heater 170 heats the reservoir 164 to maintain the liquid-like viscosity of the UV gel ink contained in the reservoir 164. The leveling device 148 is configured to blend the ink ejected onto the substrate 114 into a substantially continuous area. In particular, the leveling device 148 may be a thermal reflow device configured to heat the UV gel ink ejected onto the substrate 114 to a temperature that blends together ink droplets of the ink. The UV gel ink ejected onto the substrate 114 may then be exposed to the source of ultraviolet radiation 152, which is configured to cure the ink.

The main reservoir 158 and the ink reservoir 164 of the printer 102 may be configured to remain connected to the printer 102 during normal usage and servicing of the printer 102. Specifically, when the ink level in the ink reservoir 164 falls below a predetermined level, the printer 102 refills the ink reservoir 164 with ink (either phase change ink, gel ink, or another type of ink) from the main reservoir 158. Similarly, when the ink level in the main reservoir 158 falls below a predetermined level, the printer 102 is configured to fill the main reservoir 158 with additional ink from the ink loader 150. Accordingly, in one embodiment, neither the main reservoir 158 nor the ink reservoir 164 are disposable units configured to be replaced when the printer 102 exhausts an ink supply.

The cooler 108 prevents show-through that may result from heated phase change ink contacting the substrate 114. Some types of phase change ink when ejected onto an uncooled substrate 114 may locally heat the substrate 114 and at least partially penetrate a thickness of the substrate 114 causing show-through. The cooler 108, however, causes the phase change ink ejected onto the substrate 114 to freeze into the solid phase before show-through occurs.

The cooler 108 also prevents show-through which may result from UV gel ink contacting the substrate 114. In one embodiment, UV gel ink may be heated to a temperature of approximately eighty five degrees Celsius and the substrate 114 may be cooled to approximately fifteen degrees Celsius. Upon contacting the cooled substrate 114, droplets of the UV gel ink ejected by the ink ejectors 166 freeze to the gelatinous state. In particular, the UV gel ink cools to a temperature that increases the viscosity of the ink and prevents the ink from penetrating a thickness of the substrate 114 to a depth that results in show-through or that results in an objectionable level of show-through. The set point temperature of the platen 120 may be selected to ensure that any heat generated by the leveling device 148 and/or the source of ultraviolet radiation 152 does not heat the ink and/or the substrate 114 to a temperature that produces show-through or that increases show-through to an objectionable level.

In one embodiment, the printer 102 of FIG. 6 may be configured to form an image with UV gel ink ejected onto a substrate such as, or similar to, Xerox 4200 Business Multipurpose Paper, referred to herein as Xerox 4200. Xerox 4200 is a porous substrate having a 20 lbs. paper weight. Paper weight is a measure of the density or thickness of a substrate. An uncut ream, consisting of approximately five hundred 17×22 inch sheets, of 20 lbs. substrate weighs about 20 lbs. When UV gel ink is ejected onto Xerox 4200 maintained at a temperature of approximately forty degrees Celsius, an objectionable amount of show-through may occur. By cooling the Xerox 4200, however, show-through can be eliminated or reduced to an acceptable level. Specifically, the cooler 108 may be configured to cool the Xerox 4200 to approximately fifteen degrees Celsius before the printhead 112 ejects UV gel ink onto the substrate 114. To cool the substrate 114 to approximately fifteen degrees Celsius the cooler 108 may cool the platen 120 to a temperature less than fifteen degrees Celsius. The temperature of the platen 120 may be determined based at least in part on the print speed of the Xerox 4200, or other type of substrate 114. For instance, the cooler 108 may maintain the platen 120 at zero degrees Celsius in order to cool the Xerox 4200 to fifteen degrees Celsius when the Xerox 4200 is moving across the platen 120 at approximately twenty five centimeters per second. Droplets of the UV gel ink ejected onto the cooled Xerox 4200 freeze to the gelatinous state before show-through results or before an objectionable level of show-through results.

Figure 7:
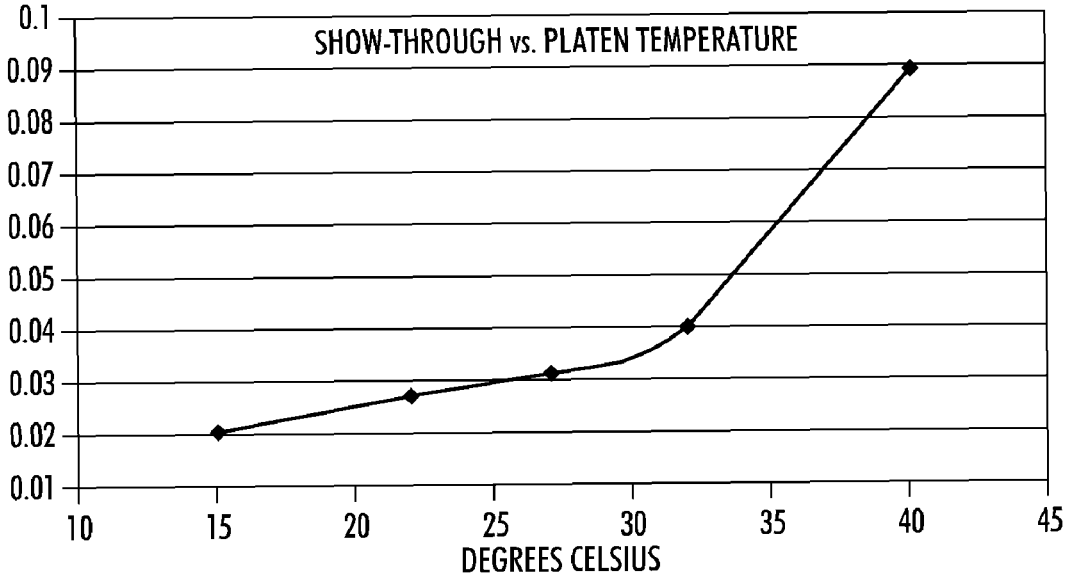
FIG. 7 is a graph depicting show-through versus platen temperature.

Referring to FIG. 7, a graph of show-through versus platen temperature illustrates a reduction in show-through in response to a reduction in the temperature of the platen 120. Show-through is measured on the vertical axis and is shown as a unit-less quantity. As used herein, a value of zero show-through represents no detectable show-through or an insignificant level of show-through, as may occur on a dense substrate, such as a coated paper, among other types of substrates 114. A value of show-through greater than zero represents a detectable level of show-through. In the non-limiting example depicted in the graph of FIG. 7, reducing the temperature of the platen 120 from forty degrees Celsius to fifteen degrees Celsius reduced show-through by approximately four hundred fifty percent.

Show-through may be quantitatively determined by subtracting a front density from a back density. In particular, back density may be determined by directing a reflection densitometer at the reverse side of a substrate having ink affixed to the obverse side. Front density may be determined by first placing an ink-free section of substrate directly on top of an ink covered section of substrate. Next, a reflection densitometer may be directed at the ink-free section of substrate to determine a front density value. Values of show-through quantitatively determined may be scaled to a suitable range by multiplying the values of show-through by a proportionality constant.

Those skilled in the art will recognize that numerous modifications may be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An inkjet printer comprising:

a printhead configured to eject ink onto an ink receiving member as the ink receiving member is transported along a portion of a media path through an inkjet printer;

a platen positioned proximate the media path prior to the printhead, the platen having a plurality of platen sections and being configured to cool the ink receiving member to a temperature less than an ambient temperature prior to the printhead ejecting ink onto the ink receiving member; and a cooling device positioned proximate the media path and being thermally coupled to each platen section selectively to remove heat from the platen.

2. The inkjet printer of claim 1 further comprising:

a heater coupled to the printhead and configured to heat the printhead to a temperature that enables ejection of a liquid ink by the printhead.

3. The inkjet printer of claim 2, further comprising:

a radiation source positioned proximate the media path subsequent to the printhead to expose the ejected liquid ink to radiation having a wavelength that cures the liquid ink.

4. The inkjet printer of claim 1 wherein each platen section is comprised of at least one of aluminum, aluminum alloy, copper, and copper alloy.

5. The inkjet printer of claim 1 further comprising:

a conduit thermally coupled to the cooling device and positioned proximate the platen, the conduit configured to enable a fluid cooled by the cooling device to remove heat from the platen.

6. The inkjet printer of claim 1 further comprising:

a temperature sensor coupled to the platen; and a controller coupled to the temperature sensor and the cooling device, the controller being configured to compare a temperature measured by the temperature sensor to a temperature range and to activate selectively the cooling device in response to the temperature measured by the temperature sensor being outside of the temperature range.

7. The inkjet printer of claim 1 further comprising:

a temperature sensor coupled to the platen; and a controller coupled to the temperature sensor and the cooling device, the controller being configured to compare a temperature measured by the temperature sensor to a set point and to activate selectively the cooling device in response to the temperature measured by the temperature sensor being greater than the set point.

8. A printing system, comprising:

a support frame configured to define a media path;

a printhead configured to eject ink onto an ink receiving member as the ink receiving member is transported along a portion of the media path;

a platen having a plurality of platen sections, the platen being coupled to the support frame and being configured to cool the ink receiving member to a temperature less than an ambient temperature prior to the printhead ejecting ink onto the ink receiving member; and a cooling device coupled to the support frame and thermally coupled to each platen section selectively to remove heat from the platen.

9. The printing system of claim 8, further comprising:

a temperature sensor coupled to the platen; and a controller coupled to the temperature sensor and the cooling device, the controller being configured to compare a temperature measured by the temperature sensor to a temperature range or a set point temperature, and to activate selectively the cooling device in response to the temperature measured by the temperature sensor being outside of the temperature range or being greater than the set point temperature.

10. The printing system of claim 8 wherein the printhead defines a print width, a group of platen sections each has a width less than the print width, and a total width of the group of platen sections is at least equal to the print width.

11. The inkjet printer of claim 10, the ink receiving member being a substantially continuous web.

12. The printing system of claim 8 wherein:

the printhead defines a print width, and at least one of the platen sections has a width at least equal to the print width.

13. The printing system of claim 8 further comprising:

a plurality of valves, each valve being configured to couple thermally the cooling device to a platen section in response to the valve being in a first position, and each valve configured to decouple thermally a platen section from the cooling device in response to the valve being in a second position.

14. A method of forming and fixing a printed image on an ink receiving member, the method comprising:

thermally coupling each platen section of a plurality of platen sections forming a platen to a cooling device selectively to maintain the platen at a first predetermined temperature;

exposing an ink receiving member to the platen to bring the ink receiving member to a second predetermined temperature; and ejecting ink droplets onto the cooled ink receiving member with a printhead.

15. The method of claim 14 further comprising:

cooling a fluid with the cooling device; and thermally coupling the fluid to each platen section selectively.

16. The method of claim 14, further comprising:

blending the ink droplets ejected onto the cooled ink receiving member into a substantially continuous area with a leveling device; and curing the blended ink droplets by exposing the ink droplets to a radiation source.

* * * * *